United States Patent [19]

Flynn et al.

[11] Patent Number: 5,010,598

[45] Date of Patent: Apr. 30, 1991

[54] SAFETY HELMET

[75] Inventors: David P. Flynn; John E. Oretti, both of Blackburn, Australia

[73] Assignee: Britax Child-Care Products Pty. Ltd., Victoria, Australia

[21] Appl. No.: 473,904

[22] Filed: Feb. 2, 1990

[51] Int. Cl.[5] ..... A42B 1/06

[52] U.S. Cl. ..... 2/410; 2/411; 2/414; 2/424

[58] Field of Search ..... 2/410, 411, 414, 424, 2/425

[56] References Cited

U.S. PATENT DOCUMENTS

| | | | |
|---|---|---|---|
| 3,925,821 | 12/1975 | Lewicki | 2/425 |
| 4,020,507 | 5/1977 | Morton | 2/411 |
| 4,028,739 | 6/1977 | Bell et al. | 2/411 X |
| 4,434,514 | 3/1984 | Sundahl et al. | 2/425 |
| 4,519,099 | 5/1985 | Kamiya et al. | 2/425 X |
| 4,555,816 | 12/1985 | Broersma | 2/425 |
| 4,575,875 | 3/1986 | Dawson et al. | 2/422 |
| 4,653,123 | 3/1987 | Broersma | 2/425 |
| 4,901,373 | 2/1990 | Broersma | 2/425 X |
| 4,903,350 | 2/1990 | Gentes et al. | 2/425 X |

FOREIGN PATENT DOCUMENTS

| | | | |
|---|---|---|---|
| 533290 | 9/1955 | Italy | 2/411 |
| 8603950 | 7/1986 | PCT Int'l Appl. | 2/424 |
| 8604791 | 8/1986 | PCT Int'l Appl. | 2/411 |
| 8901744 | 3/1989 | PCT Int'l Appl. | 2/410 |
| 475803 | 11/1937 | United Kingdom . | |
| 1255305 | 12/1971 | United Kingdom . | |
| 2014036 | 8/1979 | United Kingdom . | |
| 1578351 | 11/1980 | United Kingdom . | |

*Primary Examiner*—Peter Nerbun
*Assistant Examiner*—Michael A. Neas
*Attorney, Agent, or Firm*—Klauber & Jackson

[57] ABSTRACT

A safety helmet comprises a main body, an overbody spaced from the main body to form an air space between the two, an inner body within the main body, primary air vent apertures extending upwardly and outwardly through the inner and main bodies to the air space, and secondary air vent apertures extending upwardly and outwardly through the overbody, so that both the air within the main body, and within the air space between the main and over bodies, will vent by convection when heated.

9 Claims, 3 Drawing Sheets

SAFETY HELMET

Figure 1:
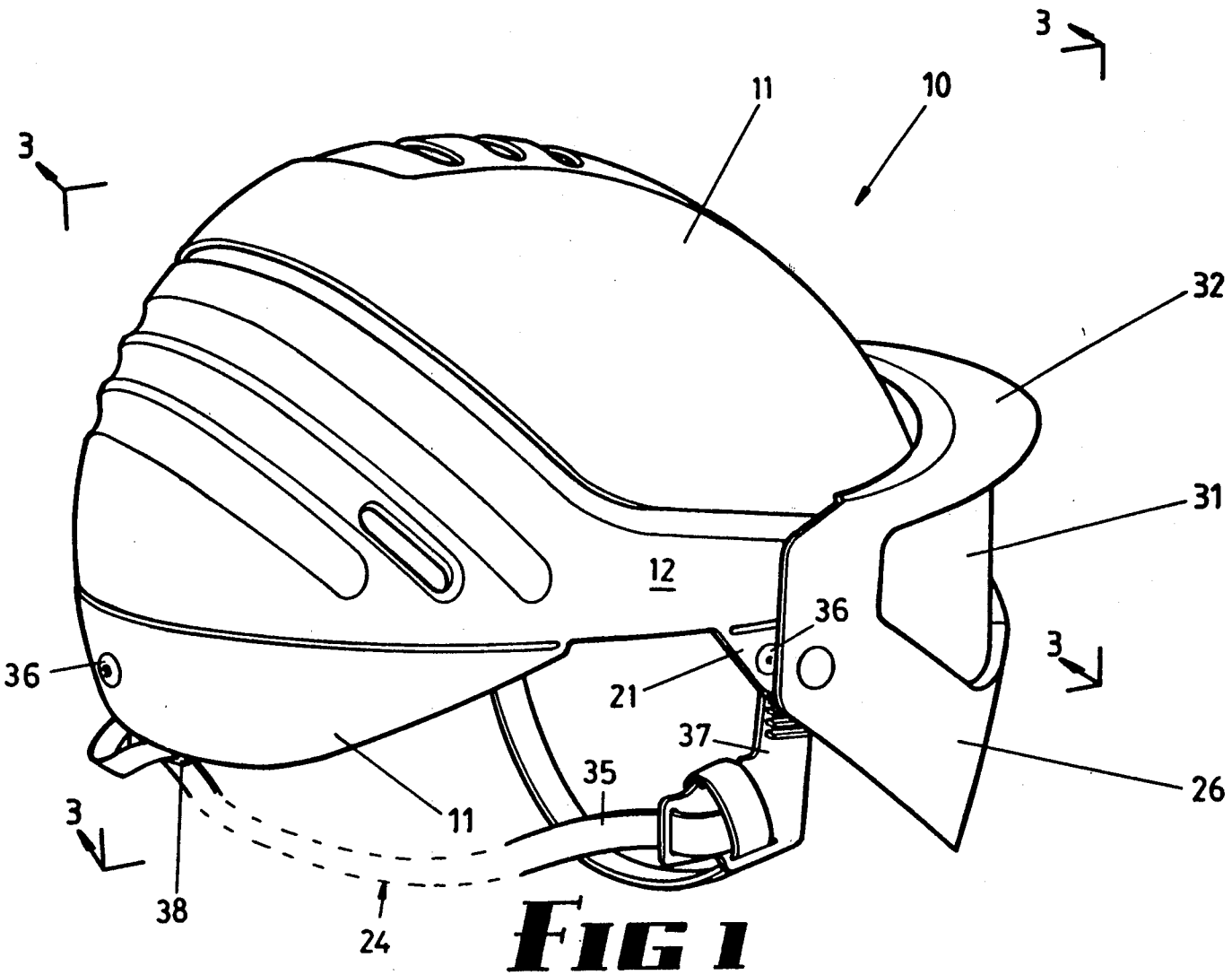

This invention relates to a safety helmet such as might used by a cyclist protect his head against injuries in the case of accident.

BACKGROUND OF THE INVENTION

Safety helmets are well known and in common use, most safety helmets comprising an outer moulding of plastics material in contact with an inner close fitting foam moulding. In case of an accident, the helmet is usually capable of withstanding the shock loads, providing two stages of deceleration, and there is a degree of resilience before the helmet applies force to the head, and even when this occurs, the force is more evenly spread and over a wider area by partial collapse of the foam, so that the danger of concussion is reduced.

One object of this invention is to provide improvements whereby there is still a further stage of deceleration upon impact, so that the danger of concussion is still further reduced.

One objection which is sometimes levelled against safety helmets is their inability to "breathe", and the consequential high degree of heat which is imparted through the helmet to the skull, and sometimes this is in addition to heat generated within the helmet by the head of a user. In order to overcome this problem in the past it has been known to utilise a helmet having a single body with vents therein, but the vents provided only limited effect as far as ventilation is concerned, and further, the existence of vent apertures resulted in loss of some mechanical strength of the helmet.

There is also frequently a requirement of change of style of a helmet, particularly when used for sporting activities, and prior art helmets have not usually provided facilities for such change.

PRIOR ART

The closest prior art known to the Applicant comprises four British patent specifications:

475803 BATHGATE disclosed a helmet with a main body containing tapes stitched to a sweat band and arranged to be adjusted to suit different users. Downwardly facing vents surrounded a portion of the main body near, but not at, its top. There was no overbody disclosed which defined an air space with the main body, and no provision for effective convection. The tapes were not equivalent to an inner body since they served a negligible insulating function.

1255305 PAYER disclosed a helmet with a main body and an inner body which could have some insulating effect, and apertures through the inner body allowed air to pass into an air space between the inner and main bodies, and be expelled through a rear vent low in the main body, when the helmet was worn on a moving vehicle. No provision was made for an overbody, and air venting by convection.

1578351 DU PONT CANADA disclosed a vented inner body and a generally imperforate main body, with vents only near its lower/edge. No provision was made for an overbody, and air venting by convection.

2014036 CANADIAN PATENTS disclosed a main body and an inner body, both of which were generally imperforate, and air under pressure flowed through a space between the bodies. There is no provision for an overbody, and air venting by convection.

BRIEF SUMMARY OF THE INVENTION

With the object of overcoming the above difficulties, in an embodiment of this invention a safety helmet comprises a main body, an overbody spaced from the main body to form an air space between the two, an inner body within the main body, primary air vent apertures extending upwardly and outwardly through the inner and main bodies to the air space, and secondary air vent apertures extending upwardly and outwardly through the overbody, so that both the air within the main body, and within the air space between the main and over bodies, will vent by convection when heated.

By having the overbody in addition to the main body, the additional strength which is made available is such as to at least partly counteract the loss of strength due to the vent apertures and thereby the vent apertures can be of a more effective size, than with previous helmets, and can be located to provide effective ventilation solely by convection. Since the overbody can itself comprise a semi-rigid moulding, some collapse of the moulding will occur before the main body receives impact, thereby providing a further stage of deceleration.

If the overbody is formed of plastics material having a distinctive colour, it can easily be replaced with another having another distinctive colour.

Figure 2:
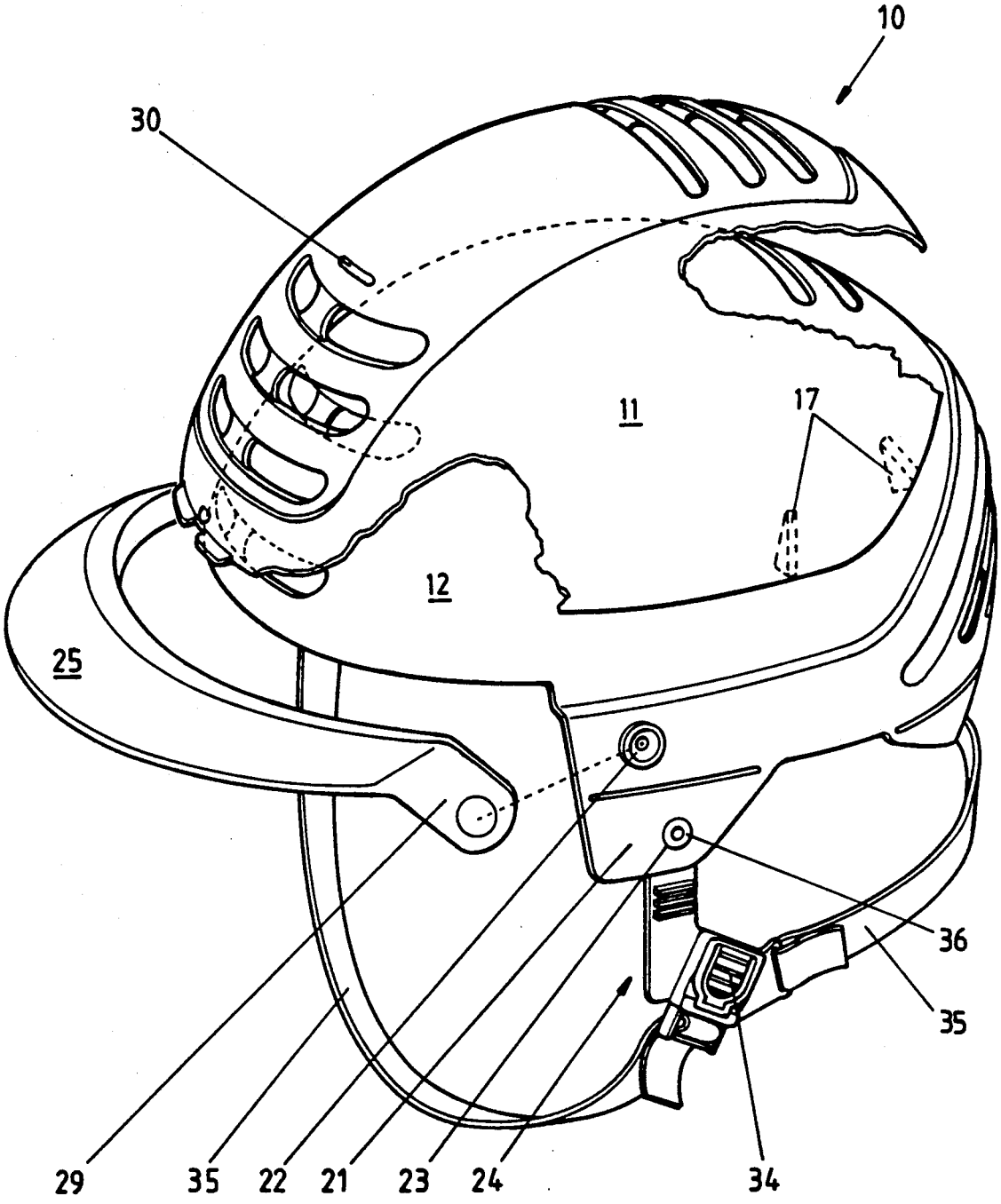
Figure 3:
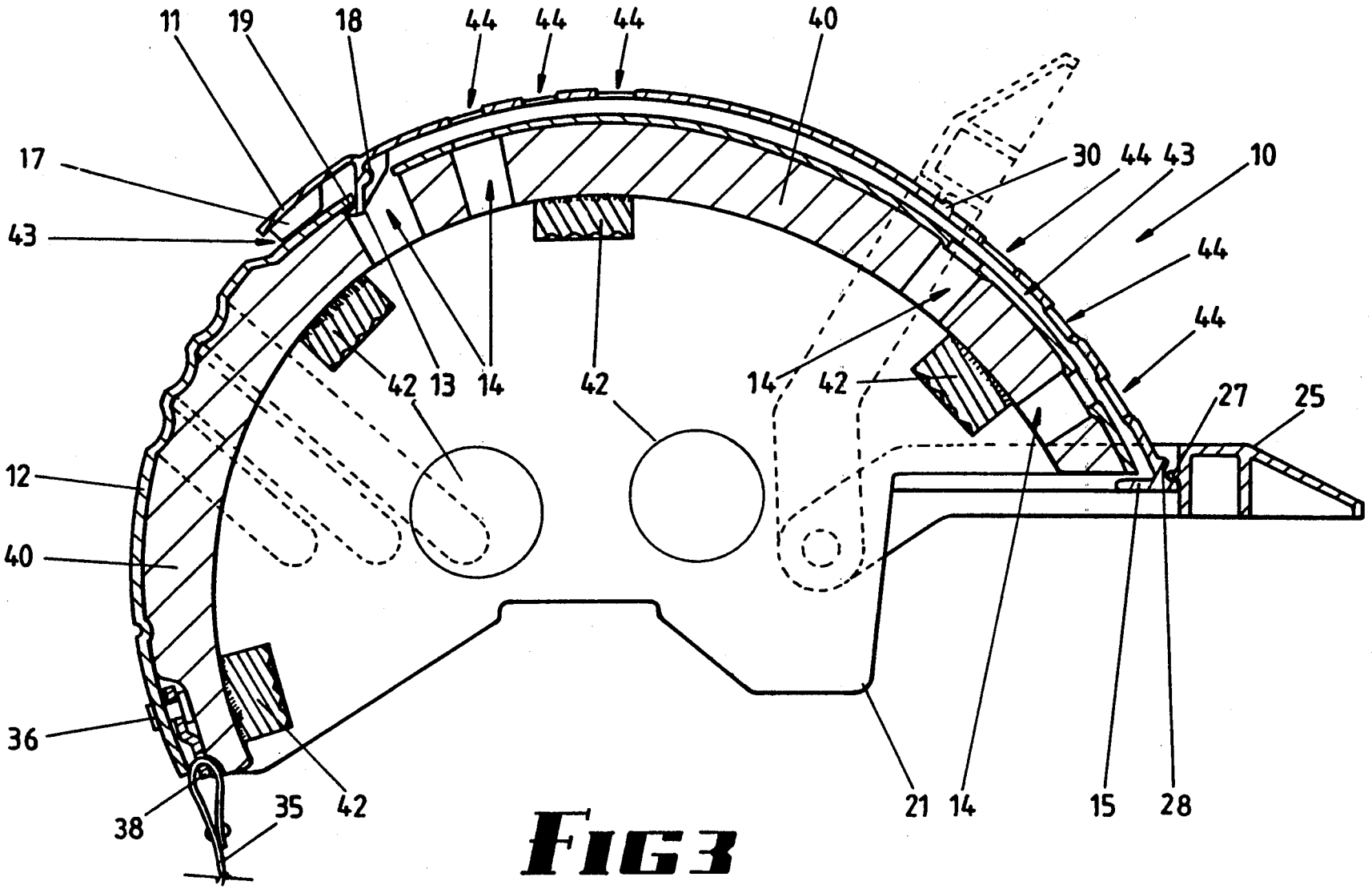

An embodiment of the invention is described hereunder in some further detail with reference to and is illustrated in the accompanying sketches in which:

FIG. 1 is a rear perspective view of a safety helmet according to this invention, showing a visor attachment, FIG. 2 is a front perspective view of the same helmet, partly "exploded", but showing a shading peak attachment in lieu of the visor, and FIG. 3 is a section taken on plane 3—3—3—3 of FIG. 1, drawn however to a larger scale, also showing a shading peak in lieu of the visor of FIG. 1.

In this embodiment, a safety helmet 10 comprises an overbody 11 and a main body 12, both the main body 12 and the overbody 11 being of plastics material.

Spacer means comprise inwardly directed spacer ribs (referred to below) on the overbody 11 which position the overbody 11 against displacement on the main body 12 in a lateral direction and maintain an air space between the bodies, while the combination of a latch 13 (FIG. 3) of the overbody 11 which engages an edge of a primary vent aperture 14 in the main body 12, and a flange 15 at the front end of the overbody 11 which engages the front portion of the main body 12, the combination of latch 13 and flange 15 retaining the overbody 11 on the main body 12. The primary air vents 14 are located near the top of main body 12, and oriented into an air space between the overbody 11 and main body 12, into which air heated by a user's head can vent solely by convection. The arrangement is such however that by resilient deformation of the overbody 11, the flange 15 can be moved forwardly of the front portion of main body 12 and the overbody can be readily unlatched and removed. This can be regarded as a "semi-permanent" connection between the two body portions, but enables the overbody portion to be replaced in case of damage, or if a different style or colour is required for different purposes.

The inwardly directed spacer ribs include radial ribs 17, and transverse latch spacer ribs 18 which urge a latch portion 19 of latch 13 into engagement with the inner surface of the main body 12 when the overbody is in position, such that the position is retained until the overbody is levered outwardly (in an anticlockwise direction as shown in FIG. 3). This can only occur however When the overbody 11 has been resiliently deformed in shape to urge the flange 15 forwardly from its engagement with the front end of the main body 12.

However, alternative designs of clips, including secondary clips, may be used for releasably retaining the overbody 11 to the main body 12.

The main body 12 is provided with a pair of side wings 21, above which are first press stud parts 22 (FIG. 2). Apertures 23 are in wings 21, and provide anchor points for the ends of a retention strap assembly 24.

A peak 25 is retained in the studs 22 by means of complementary second press stud parts, or alternatively inwardly directed conical projections (not shown), one on each respective said side. Alternatively a visor 26 (FIG. 1) can be retained to the main body 12.

For positioning, the peak 25 can be rotated about the axis of press studs 22 until the rearward projecting rib 27 on the peak snaps over a forwardly projecting nib 28 on the overbody 11, stopping on flange 15. This enables the peak to "snap-in" to its lower position as shown in FIG. 3. Another nib 30 exists higher on the overbody 11 to enable the peak to snap over and remain in a raised position shown dotted in FIG. 3. The side wings 29 of the peak 25 must spring outwardly until each complementary second press stud part is disengaged from its first press stud part 22 for the peak to be removed.

Visor 26 (FIG. 1) may also be assembled in lieu of the peak 25 in the same manner which is only semi-permanent so that visors can be replaced when damaged or scratched. The visor 26 has clear plastics material 31 of part-circular or arcuate shape in plan, and has a pair of engagement ribs one on each end and a further intermediate engagement rib at the centre which releasably engages complementary surfaces within the visor upper wall 32 so that the material 31 may be removed or replaced. These ribs ar ®not separately shown.

Strap assembly 24 comprises a releasable buckle 34 on one side of the helmet 10 (FIG. 2), a strap 35, a three way anchor guide 37 on the other side, a central anchor guide 38 at the rear, and fasteners 36 secure the assembly at three places. The length of the webbing of the strap can be readily adjusted as shown.

As shown in FIG. 3, a moulding 40 of semi-rigid polystyrene foam is contained within the main body 12, being cemented to its inner surface, the function of the foam being to provide a soft body for engagement by the head of a user in the case of accident primary vent apertures 14 also extend through moulding 40. A plurality of soft foam sizing-pads 42 extend into the "head space " within the moulding 40, being retained to its inner surface by "touch-and-hold" strips, such as sold under the Trade Mark VELCRO. In use, a plurality of pads 42 of varying dimension are supplied, so that the helmet can be "fitted" to a user. If the user is a child, longer pads 42 would be selected, but as the child's head grows, they can be replaced by shorter pads. Alternatively, all the pads 42 can be retained in place, the longer ones being removed as a head increases in size. These pads 42 also provide an air space between a user's head and the polystyrene foam moulding 40. The vent apertures 14 are located between the soft pads 42, and extend through both the polystyrene foam moulding 40 and the main body 12 to the "verandah" air space 43 between the main body 12 and overbody 11. Overbody 11 contains secondary vents 44 which are so positioned near the top that, when heated above environmental temperature, air can vent from the air space 43 by convection.

A consideration of the above embodiment will indicate that the "verandah air space" 43 between the main body 12 and the overbody 11 provides a shade effect for the main part of the main body 12, and the overbody 11 provides means whereby the venting can be more effective, and provides means for an initial stage of deceleration which has the effect of reducing shock to a user in the case of an accident. Secondary and tertiary stages of deceleration are provided by moulding 40, and the main body 12. A secondary air space surrounds the head of a user, within the moulding 40. It will be seen that the removal of the overbody from the main body is so restrained at the registration points that, to remove the overbody, it is necessary to separate at the latching points, except in the case of a severe impact such as may occur under accident conditions, when the overbody is likely to spring clear after it has distorted. Varying aesthetic appearances can be provided by combining the main body and overbody shapes and colours, and also varying the peak shapes or colours.

The claims defining the invention are as follows; We claim:

1. A safety helmet comprising:

a main body of a shape to entirely overlie the head of a wearer, an overbody, means for securing the overbody to extend over a portion of the main body, spacer ribs between the overbody and the main body separating said bodies and thereby maintaining an air space therebetween, an inner body, means for securing the inner body within the main body, vent surfaces extending through both the inner body and the main body defining primary vents opening upwardly therefrom to said air space, and further vent surfaces in the overbody defining secondary vents opening upwardly from the overbody, the configuration being such that air located within the inner body is heated by a wearer of the helmet and moves upwardly through the primary vents into said air space by convection, and air within said air space having a higher air temperature than environmental air temperature moves upwardly and outwardly therefrom through the secondary vents by convection.

2. A safety helmet according to claim 1 wherein said inner body comprises foam polymeric material.

3. A safety helmet comprising:

a main body, an overbody extending over at least a portion of the main body, spacer means between the overbody and the main body for maintaining an air space therebetween, securing means for securing the overbody to the main body and comprising a flange near the front of the overbody engaging the front of the main body, and a latch near the rear of the overbody extending through a primary vent of the main body and engaging an inner surface of the main body, the overbody being of a resilient plastics material deformable to release said latch engagement, vent surfaces in the main body defining primary vents opening upwardly therefrom to said air space, and further vent surfaces in the overbody defining secondary vents opening upwardly from the overbody, the configuration being such that air located within the main body is heated by a wearer of the helmet and moves upwardly through the primary vents into said air space by convection, and air within said air space having a temperature higher than environmental air temperature moves upwardly and outwardly therefrom by convection.

4. A safety helmet according to claim 3 wherein said latch comprises a portion of the spacer means extending between the bodies.

5. A safety helmet according to claim 3 wherein said spacer means comprise transversely extending spacer ribs projecting from an inner surface of the overbody.

6. A safety helmet according to claim 3 further comprising soft foam head engaging sizing pads of different dimension, and retention means for retaining at least some of said sizing pads to the inner surface of the helmet to project into the helmet.

7. A safety helmet according to claim 3 wherein the main body comprises depending wings on respective sides, a retention strap assembly, and fasteners securing the retention strap assembly to the wings.

8. A safety helmet according to claim 3 wherein the main body comprises opposed first press stud parts on opposite sides, and further comprising a peak having inwardly directed complementary second press stud parts engaging respective first press stud parts, the peak being of a resilient plastics material deformable to release said engagement of those apertures by the projections.

9. A safety helmet according to claim 3 wherein the main body comprises first opposed press stud parts on opposite sides, further comprising a visor having inwardly, directed complementary second press stud parts engaging respective first press stud parts, the visor being of a resilient plastics material deformable to release said engagement of the first and second press stud parts.

* * * * *